US009169446B2

(12) United States Patent
Yusuf et al.

(10) Patent No.: US 9,169,446 B2
(45) Date of Patent: Oct. 27, 2015

(54) DEMULSIFICATION OF EMULSIFIED PETROLEUM USING CARBON DIOXIDE AND RESIN SUPPLEMENT WITHOUT PRECIPITATION OF ASPHALTENES

(71) Applicant: Saudi Arabian Oil Company, Dhahran (SA)

(72) Inventors: Zaki Yusuf, Dhahran (SA); Bandar Fadhel, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 99 days.

(21) Appl. No.: 14/143,711

(22) Filed: Dec. 30, 2013

(65) Prior Publication Data

US 2015/0184085 A1 Jul. 2, 2015

(51) Int. Cl.

| | |
|---|---|
| ***C10G 33/04*** | (2006.01) |
| ***B01D 17/04*** | (2006.01) |
| ***C10G 33/08*** | (2006.01) |

(52) U.S. Cl.

CPC ..... *C10G 33/08* (2013.01)

(58) Field of Classification Search

CPC ..... B01D 17/04; C10G 33/04

See application file for complete search history.

(56) References Cited

U.S. PATENT DOCUMENTS

| | | | | |
|---|---|---|---|---|
| 2,541,458 | A | 2/1951 | Berg | |
| 3,231,487 | A * | 1/1966 | Nettles | 208/188 |
| 3,649,500 | A | 3/1972 | Watson et al. | |
| 3,969,196 | A | 7/1976 | Zosel | |
| 4,098,692 | A | 7/1978 | Baker et al. | |
| 4,746,420 | A | 5/1988 | Darian et al. | |
| 4,778,591 | A | 10/1988 | Reynolds | |
| 4,964,995 | A | 10/1990 | Chum et al. | |
| 5,120,900 | A | 6/1992 | Chen et al. | |
| 5,143,594 | A | 9/1992 | Stephenson et al. | |
| 5,329,045 | A | 7/1994 | Dedieu et al. | |
| 6,183,521 | B1 | 2/2001 | Lin et al. | |
| 6,187,175 | B1 | 2/2001 | Blum et al. | |
| 6,248,797 | B1 | 6/2001 | Dias et al. | |
| 6,566,410 | B1 * | 5/2003 | Zaki et al. | 208/188 |
| 7,622,035 | B2 * | 11/2009 | Zaki et al. | 208/309 |
| 8,257,579 | B2 | 9/2012 | Barrero et al. | |
| 8,431,358 | B2 | 4/2013 | Sadowski et al. | |
| 8,574,426 | B2 | 11/2013 | Mezza et al. | |
| 2004/0065353 | A1 | 4/2004 | Tunnicliffe et al. | |
| 2011/0049016 | A1 | 3/2011 | McGrady et al. | |
| 2011/0098507 | A1 | 4/2011 | Cohrs et al. | |
| 2012/0279902 | A1 | 11/2012 | McGrady et al. | |

FOREIGN PATENT DOCUMENTS

| | | | |
|---|---|---|---|
| CA | 949910 | A * | 6/1974 |
| CA | 1023677 | A * | 1/1978 |
| CN | 103214332 | A | 7/2013 |
| DE | 10 2007 060 651 | B3 | 6/2009 |
| EP | 0 922 746 | A2 | 6/1999 |
| EP | 1177269 | | 2/2002 |
| EP | 2164930 | A1 | 3/2010 |
| EP | 2 338 955 | A1 | 6/2011 |
| EP | 2542651 | A1 | 1/2013 |
| EP | 2571961 | A2 | 3/2013 |
| WO | 200056842 | A1 | 2/2000 |
| WO | 00/76617 | A1 | 12/2000 |
| WO | 2002066137 | A1 | 8/2002 |
| WO | 2008154576 | A1 | 12/2008 |
| WO | 2010148204 | A2 | 12/2010 |
| WO | 2011081601 | A1 | 7/2011 |
| WO | 2011106891 | A1 | 9/2011 |
| WO | 2011145086 | A2 | 11/2011 |
| WO | 2013089866 | A1 | 6/2013 |
| WO | 20130121219 | A1 | 8/2013 |

OTHER PUBLICATIONS

Nael N. Zaki et al., A Novel Process for Demulsification of Water-in-Crude Oil Emulsions by Dense Carbon Dioxide, 42 Ind. Eng. Chem. Res. 6661-6672 (2003).*

International Search Report and Written Opinion dated Mar. 16, 2015 pertaining to International Patent Application No. PCT/US2014/068048.

International Search Report and Written Opinion dated Mar. 18, 2015 pertaining to International Patent Application No. PCT/US2014/068047.

Notice of Allowance dated Oct. 8, 2014 pertaining to U.S. Appl. No. 14/107,471.

Nael, N. Zaki, Rueben G. Carbonell, Peter K. Kilpatrick; A Novel Process for Demulsification of Water-in-Crude Oil Emulsions by Dense Carbon Dioxide; Ind. Eng. Chem. Res. 2003, 42, pp. 6661-6672.

Xiaoli Yang, Vincent J. Verruto, Peter K. Kilpatrick; Dynamic Asphaltene-Resin Exchange at the Oil/Water Interface: Time-Dependent W/O Emulsion Stability for Asphalterie/Resin Model Oils; Energy & Fuels 2007, 21, pp. 1343-1349.

Kamran Akbarzadeh, Ahmed Hammami, Abdel Kharrat, Dan Zhang, Stephan Allenson, Jefferson Creek, Shah Kabir, A. Jamaluddin, Alan G. Marshall, Ryan P. Rodgers, Olver C. Mullinsm Trond Solbakken, Asphaltenes-Problematic but Rich in Potential; Oilfield Review, Summer 2007, pp. 22-43.

(Continued)

*Primary Examiner* — Randy Boyer

(74) *Attorney, Agent, or Firm* — Dinsmore & Shohl LLP

(57) ABSTRACT

Methods for demulsifying an emulsified petroleum source having a predetermined resin-to-asphaltene ratio without substantial aggregation or precipitation of asphaltenes may include adding a resin supplement to the emulsified petroleum source to form a resin-supplemented emulsion having a resin-to-asphaltene ratio above a predetermined critical value. An acidic-to-basic ratio of acidic functional groups to basic functional groups in the supplemented emulsion may be adjusted to be from about 0.25 to about 4.0. The resin-supplemented emulsion may be contacted with carbon dioxide to form an initial mixture having an emulsified oil phase and an emulsified aqueous phase. The initial mixture may be stabilized to facilitate rupture of the resin-supplemented emulsion, to cause phase separation, and to allow removal of a separated oil phase. The resin-to-asphaltene ratio being above the predetermined critical value in the supplemented emulsion maintains asphaltene suspension during demulsification, such that asphaltene agglomeration and precipitation are avoided.

19 Claims, 4 Drawing Sheets

(56) References Cited

OTHER PUBLICATIONS

T. Falkler, C. Sandu; Fine-tune processing heavy crudes in your facility; Hydrocarbon processing, Sep. 2010, pp. 67-73.
Joseph D. McLean, P. Matthew Spiecker, Andrew P. Sullivan, Peter K. Kilpatrick, The Roll of Petroleum Asphallenes in the Stabilization of Water-in-Oil Emulsions; Chapter XII: Structures and Dynamics of Asphaltenes: 1998, pp. 377-422.
Joseph D. McLean, Peter K. Kilpatrick, Effects of Asphaltene Solvency on Stability of Water-in-Crude-Oil Emulsions: Journal of Colloid and Interface Science 189: Article No. CS974807; 1997; pp. 242-253.
Ali Chamkalani: Correlations between SARA Fractions, Density, and RI to Investigate the Stability of Asphaltene: International Scholarly Research Network; ISRN Analytical Chemistry; vol. 2012; Article ID 219276; pp. 1-6.
P. Matthew Spiecker, Keith L. Gawrys, Chad B. Trail, Peter K. Kilpatrick; Effects of petroleum resins on asphaltene aggrefation and water-in-oil emulsion formation; Elsevier Science B.V.; Colloids and Surfaces A: Physichem. Eng. Aspects 220; 2003; pp. 9-27.
Production Enhancement: Paraffin and Asphatene Control; Paraffin and Asphaltene Deposits can be Literally Choking Off Your Production and Creating Very Expensive Mechanical Problems; Halliburton Communication; H04347; 2005: pp. 1-4; http://www.halliburton.com/public/pe/contents/Brochures/Web/H04347.pdf; accessed via internet: Aug. 4, 2014.
Solids Precipitation Inhibitor 2400: Rocanda Enterprises Ltd., SPI-2400; Feb. 26, 2002, pp. 1-5; http://www.rocanda.com/pdf/SPI%202400%20PDS.pdf; accessed via internet: Aug. 4, 2014.
Novel Application of SPI-2400 in Miscible Floods as a Preventative Measure for Ashpaltenes Precipitation; Rocanda Enterprises Ltd.; Feb. 26, 2002, pp. 1-3: http://www.rocanda.com/pdl/SPI%202400%20in%20Miscible%20Floods.pdf, accessed via internet: Aug. 4, 2014.
Xuemei Chu, Yufeng Hu, Jiguang Li, Qianqing Liang, Yansheng Liu, Xianming Zhang, Xiamind Pwng, Wenjia Yue, Desulfurization of Diesel Fuel by Extraction with [BF4]- based Ionic Liquids: Chinese Journal of Chemical Engineering, 16(6):2008; pp. 881-884.
Jian-Long Wang, Di-Shun Zhao, Er-Peng Zhou, Zhi Dong; Desulfurization of gasoline by extraction with N-alkyl-pyridinium-based ionic liquids; Journal of Fuel Chemistry and Technology; vol. 35; Issue 3; Jun. 2007; pp. 293-296.
Luisa Alonso, Alberto Arce, Maria Francisco, Ana Soto, Solvent ectraction of thiophen from n-alkanes (C7, C12, and C16) using the ionic liquid [C8mim][BF4], ScienceDired The Journal of Chemical Thermodynamics 40; 2008; pp. 966-972.
Borja Rodriguez-Cabo, Maria Francisco, Ana Soto, Alberto Arce; Hexyl dimethylpyridinium ionic liquids for desulfurization of fuels. Effect of the position of the alkyl side chains, ScienceDirect Fluid Phase Equlibria 314; 2012, pp. 107-112.
Maria Francisco, Alberto Arce, Ana Sotol; Ionic liquids on desulfurization of fuel oils: ScienceDirect Fluid Phase Equilibria 294; 2010; pp. 39-48.
Cun Zhang, Feng Wang, Xiao-Yu Pan, Xiao-Qin Liu; Study of extraction-oxidation desulfurization of model oil by acidic ionic liquid; ScienceDirect Journal of Fuel Chemistry and Technology; vol. 39; Issue 9; Sep. 2011; pp. 689-693.
Fa-Tang Li, Cheng-Guang Kou; Zhi-Min Sun; Ying-Juan Hao; Rui-Hong Liu; Di-Shun Zhao; Deep extractive and oxidative desulfurization of dibezothiphene with C5H9NO.SnCl2 coordinated ionic liquid; SciVerse ScienceDirect Journal of Hazardous Materials 205-206; 2012; pp. 164-170.
Josef Planeta, Pavel Karasek, Michal Roth; Distribution of sulfur-containing aromatics between [hmim][TI2N] and supercritical CO2: a case study for deep desulfurization of oil refinery streams by extraction with ionic liquids; Green Chemistry; 2006; 8; pp. 70-77.
Jie Liu, Xuewen Sun, Dongbao Fu, Suoqi Zhao: Phase equilibria for separation of high boiling point organics from ionic liquids by supercritical CO2 or C3H8; Chemical Engineering Journal 147; 2009: pp. 63-70.
Norihito Hiyoshi, Yuki Murakami, Aritomo Yamaguchi, Osamu Sato, Chandrashekhar V. Rode, Masayuki Shirai; Purification of hydrocardons from aromatic sulfur compounds by supercritical carbon dioxide extraction: The Journal of Supercritical Fluids 55; 2010; pp. 122-127.
International Search Report and Written Opinion dated Aug. 6, 2015 pertaining to International Application No. PCT/US2015/031327.

* cited by examiner

DEMULSIFICATION OF EMULSIFIED PETROLEUM USING CARBON DIOXIDE AND RESIN SUPPLEMENT WITHOUT PRECIPITATION OF ASPHALTENES

BACKGROUND

1. Field

The present specification generally relates to petroleum processing and, more specifically, to methods for demulsifying an emulsified petroleum source using carbon dioxide without precipitation of petroleum components such as asphaltenes during the demulsification.

2. Technical Background

Oil in water (o/w) and water in oil (w/o) emulsions cause many problems in the petroleum industry and require attention from the oil producers during the recovery, treatment, and transportation of crude oils. Emulsion breaking is always a challenge for the oil producer and the refiners. Currently, crude oil is the most important hydrocarbon resource in the world, and heavy crudes account for a large fraction of the world's potentially recoverable oil reserves. Heavy crude oils presently account for only a small portion of the world's oil production because of their high viscosities that cause problems during transportation. Nevertheless, increasing needs for addressing the concerns related to heavy crude oils cannot be avoided, because the supply of light crude is dwindling all across the globe.

Usually, crude oil is considered to be a colloidal dispersion of asphaltene and resins, which constitute the discrete and polar components, dispersed in a continuous phase made of non-polar compounds. Crude oil may also be described as a heterogeneous, complex organic mixture predominantly composed of saturated and aromatic hydrocarbons. It also contains heteronuclear compounds, emulsified water, and other inorganics. The hydrocarbon portion contains normal alkanes, isoalkanes, cycloalkanes, and aromatics (mono-, di-, and polynuclear aromatic hydrocarbons (PAHs) with alkyl side chains); resins (aggregates with a multitude of building blocks such as sulfoxides, amides, thiophenes, pyridines, quinolines and carbazoles); and asphaltenes (aggregates of extended polyaromatics, naphthenic acids, sulfides, polyhydric phenols and fatty acids) with thousands of assorted derivatives. The asphaltenes are colloidal in nature and the atomic H/C ratios ranges between 1.0 and 1.2 and N, S, and O content of a few weight percent implying that a large segment of the asphaltene backbone is constituted of fused aromatic carbons interspersed with polar functional groups containing five to seven heteroatoms per macromolecule. Asphaltenes do not have a specific chemical formula. Individual asphaltene molecules can vary in the number of atoms contained in the structure, and the average chemical formula can depend on the source.

Asphaltenes are typically present in micelles within crude oil. When crude oil is recovered as an emulsion such as an o/w emulsion or a w/o emulsion, for example, the protective shell of the micelles may be broken down, causing the asphaltenes to agglomerate or precipitate. Agglomerated or precipitated asphaltenes are notorious for fouling or clogging production equipment in the petroleum industry. Accordingly, ongoing needs exist for methods to demulsify petroleum sources such as crude oil, particularly asphaltene-rich heavy crude oil, without agglomeration or precipitation of asphaltenes.

SUMMARY

According to various embodiments, methods are provided for demulsifying an emulsified petroleum source having a predetermined resin-to-asphaltene ratio without substantial aggregation or precipitation of asphaltenes. The methods may include adding a resin supplement to the emulsified petroleum source to form a resin-supplemented emulsion having a resin-to-asphaltene ratio above a predetermined critical value. Additionally, an acidic-to-basic ratio of acidic functional groups to basic functional groups in the supplemented emulsion may be adjusted to be from about 0.25 to about 4.0. Then, the resin-supplemented emulsion may be contacted with carbon dioxide to form an initial mixture. The initial mixture may contain an emulsified oil phase and an emulsified aqueous phase. The carbon dioxide may be chosen from subcritical liquid carbon dioxide or supercritical carbon dioxide. The initial mixture may be stabilized to facilitate rupture of the resin-supplemented emulsion. From the initial mixture, a phase-separated mixture may be formed and may contain a separated aqueous phase and a separated oil phase. The separated oil phase may then be removed from the phase-separated mixture. In the methods, the resin-to-asphaltene ratio being above the predetermined critical value in the supplemented emulsion maintains asphaltene suspension in the resin-supplemented emulsion, the initial mixture, the phase-separated mixture, and the separated oil phase removed from the phase-separated mixture, such that asphaltene agglomeration and precipitation are avoided.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Reference will now be made in detail to embodiments of methods for demulsifying an emulsified petroleum source having a predetermined resin-to-asphaltene ratio without substantial aggregation or precipitation of asphaltenes. The methods for demulsifying an emulsified petroleum source will be described with reference to FIGS. 1 and 2, which illustrate an exemplary system configuration that may be used to carry out the demulsification method according to embodiments herein. Though the system of FIGS. 1 and 2 are provided as exemplary, it should be understood that the methods for demulsifying the emulsified petroleum source according to embodiments herein may be carried out using systems or apparatus of other configurations.

In the methods for demulsifying a petroleum source, unique properties of subcritical and supercritical carbon dioxide are exploited by introducing the carbon dioxide into an oil-in water (o/w) emulsion, a water-in-oil (w/o) emulsion, or other emulsions such as w/o/w or o/w/o, for example, such that the carbon dioxide not only diffuses into the oil-water phase boundary but also eventually reaches the aqueous phase to induce a substantial lowering of pH when carbonic acid is formed by interacting with the water molecules around or inside or at the emulsion film boundary. Through control of system pressure, a wide array of lower pH environments may be created that interactively deactivates the acidic properties of the carboxylic groups of asphaltenes, resin acids, and naphthenic acid groups at the o/w or w/o interface. With this deactivation, interactions among acid groups present in oil molecules and hydrogen bonds of water are deactivated or diminished as the pH of the aqueous phase drops below the $pK_a$ (acid dissociation constant) value of the carboxylic acid groups of the oil components. Thus, the interaction between dissociated carboxylic acid groups ($—COO^-$) from the oil phase and water molecules are reverted by associating the organic acid groups ($—COO^-$) with its counterion ($H^+$) and consequently disengaging polar acidic groups of oil phase molecules and hydrogen bonding in the water phase at the emulsion skin interface.

Figure 1:
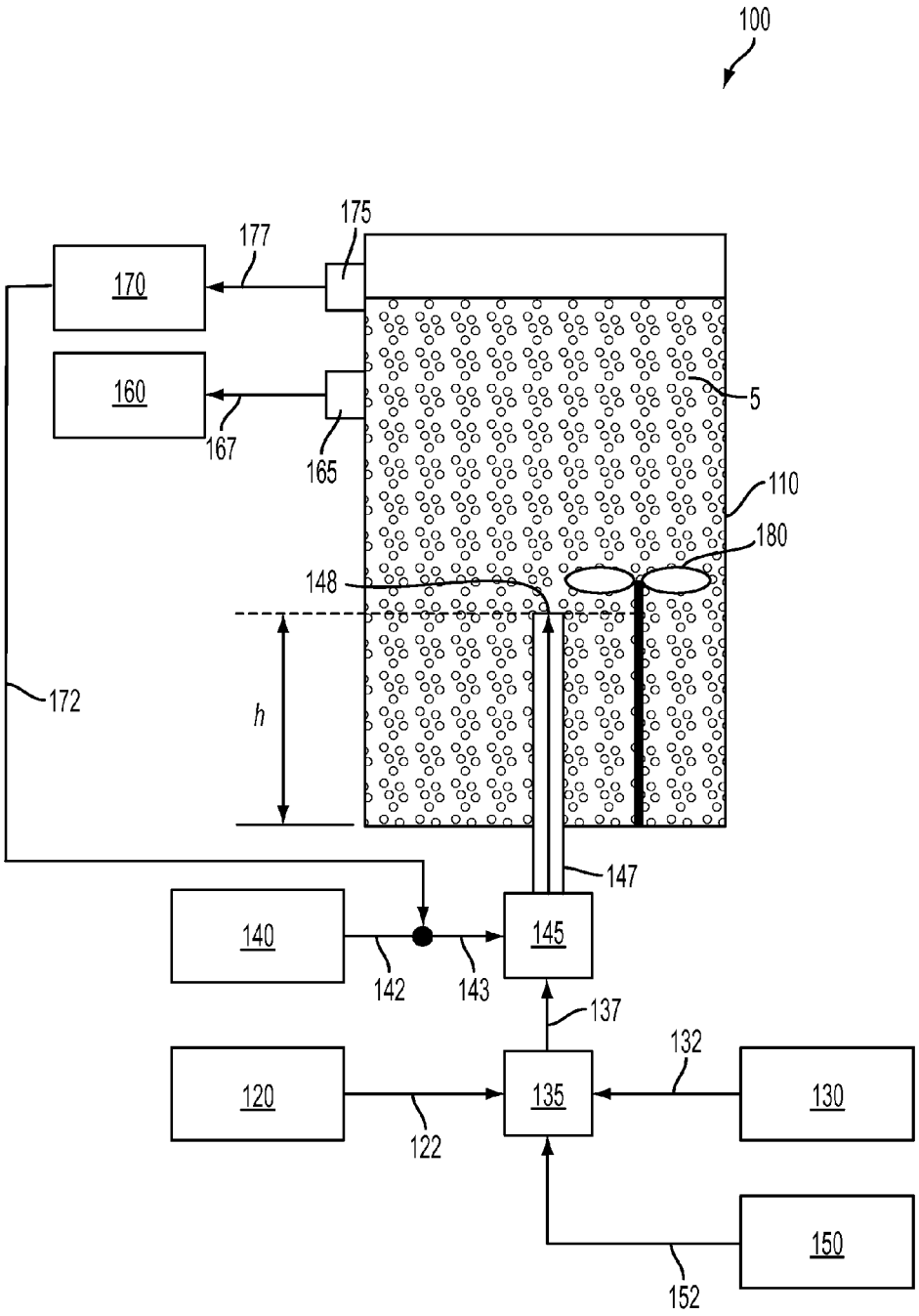
FIG. 1 is a schematic of a system for demulsifying petroleum using a method according to embodiments herein.
Figure 2:
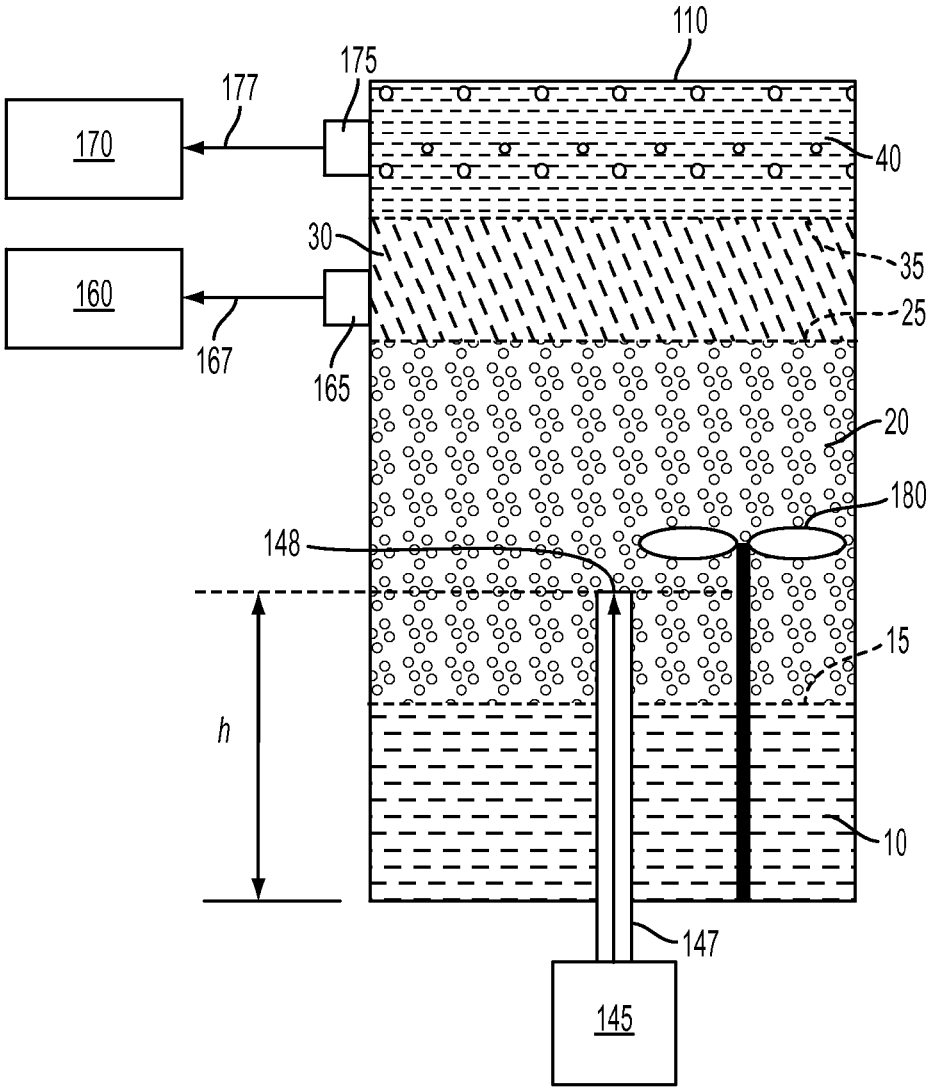
FIG. 2 is a partial schematic of the system of FIG. 1 that illustrates phase separation during demulsification of petroleum by methods according to embodiments herein.

Referring to FIG. 1, the methods for demulsifying an emulsified petroleum source having a predetermined resin-to-asphaltene ratio without substantial aggregation or precipitation of asphaltenes may be carried out in a system such as demulsification system 100, which is provided as exemplary only. The demulsification system 100 may include a demulsification vessel 110. In general, the demulsification vessel 110, may be any enclosed space capable of being pressurized, particularly to a pressure from about 1 bar to about 300 bar. In some embodiments, the demulsification vessel 110 may be an industrial apparatus such as a demulsifier. In other embodiments, the demulsification vessel 110 may be a natural formation such as a petroleum reservoir defined by natural boundaries such as rock layers within an underground crevasse, for example. If the demulsification vessel 110 is an apparatus, the demulsification system 100 may be in fluidic communication with an emulsion conduit 122 that provides an emulsified petroleum source 120 such as crude oil, for example, to the demulsification vessel 110. If the demulsification vessel 110 is a natural formation such as an oil reservoir, for example, the emulsified petroleum source may already be located within the demulsification vessel 110 and no emulsion conduit may be necessary, whereby the demulsification process is carried out as a part of oil recovery.

The demulsification vessel 110 may also be in fluidic communication with a resin conduit 132, an A/B-adjuster conduit 152, or both. When present, the resin conduit 132 provides a resin supplement 130 to the emulsified petroleum source 120 to form a resin-supplemented emulsion. As will be described in greater detail below, the resin supplement 130 may be used to raise a resin-to-asphaltene ratio ($R/A_s$) of the emulsified petroleum source 120 during or in preparation for demulsification in the demulsification vessel 110. When present, the A/B-adjuster conduit 152 provides an acid/base adjuster such as an organic acid or an organic base, for example, to the emulsified petroleum source 120. As will also be described in greater detail below, the pH adjuster may be used adjust (i.e., to raise or to lower) an acidic-to-basic functional group ratio (A/B) of the emulsified petroleum source 120 during or in preparation for demulsification in the demulsification vessel 110. In some embodiments, one or both of the resin supplement 130 and the A/B adjuster 150 may be added to the emulsified petroleum source 120 in an additive mixing zone 135 to form a resin-supplemented emulsion. In such embodiments, the resin-supplemented emulsion may be fed toward the demulsification vessel 110 by way of a supplemented mixture conduit 137, for example. In other embodiments not shown in FIG. 1, one or both of the resin supplement 130 and the A/B adjuster 150 may be added to the emulsified petroleum source 120 in the demulsification vessel 110 itself to form the resin-supplemented emulsion. In such embodiments, the resin conduit 132, the A/B-adjuster conduit 152, or both, may be connected directly to the demulsification vessel 110.

In illustrative embodiments, combining or mixing of the resin supplement, containing resin fractions or lignin-derived solvents, with the emulsified petroleum source, containing crude oil in an emulsion may be accomplished by any industrially feasible mixing process. In one exemplary embodiment, the additive mixing zone 135 may be configured as a three-way mixing valve, into which the emulsified petroleum enters from the emulsion conduit 122 through one opening in the valve, the resin supplement enters from the resin conduit 132 through a second opening, and the resin-supplemented emulsion leaves through a third opening into the supplemented mixture conduit 137. In another exemplary embodiment, the emulsified petroleum source and the resin supplement may flow through concentric pipes that transition at the additive mixing zone 135 into a single pipe, in which the emulsified petroleum stream and the resin supplement stream merge to a single stream of the resin-supplemented mixture. Optionally, spray nozzles may be incorporated into the concentric pipes to provide more efficient and complete mixing.

The demulsification system 100 may further include a carbon-dioxide source 140 that injects subcritical or supercritical liquid carbon dioxide into the supplemented mixture to form an initial mixture. In some embodiments, the initial mixture may be formed in a carbon-dioxide mixing zone 145 connected to the additive mixing zone 135 via the supplemented mixture conduit 137 and to the carbon-dioxide source 140 via a carbon-dioxide source conduit 142 and/or a carbon-dioxide injector conduit 143. In such embodiments, the initial mixture is formed in the carbon-dioxide mixing zone 145 and proceeds into the demulsification vessel 110 through a vessel inlet 147. The vessel inlet 147 may open at the bottom of the demulsification vessel 110 (not shown in FIG. 1) or may extend through the bottom of the demulsification vessel 110 and open at an inlet opening 148 inside the demulsification vessel 110 at an inlet-opening height h (as shown in FIG. 1). In other embodiments not shown in FIG. 1, the initial mixture may be formed in the demulsification vessel 110 itself by connecting the carbon-dioxide injector conduit 143 directly to the demulsification vessel 110. In such embodiments, the vessel inlet 147 may carry only the emulsified petroleum source 120 into the demulsification vessel 110 or may carry the emulsified petroleum source 120 and one or both of the resin supplement 130 and the A/B adjuster 150 into the demulsification vessel. Thus, in FIG. 1, the demulsification vessel 110 is shown partially filled with the initial mixture 5.

The demulsification system 100 may further include a suitable apparatus for agitating or mixing the initial mixture 5 to facilitate phase separation of the initial mixture 5. Though in FIG. 1 a mixing paddle 180 is shown as illustrative of such a suitable apparatus and configuration for agitating or mixing the initial mixture 5, it should be understood that any means for agitating or mixing the initial mixture 5 within the demulsification vessel 110 may be employed in any practical configuration by no means limited to the mixing paddle 180 shown in FIG. 1. Moreover, it should be understood that multiple means for agitating or mixing the initial mixture 5 may be present in the demulsification vessel 110.

The demulsification vessel 110 may further include an oil-phase outlet 165. The oil-phase outlet 165 may directs phase-separated oil through an oil-phase conduit 167 to an oil-phase recovery vessel 160. The demulsification vessel 110 may also include a carbon-dioxide outlet 175. The carbon-dioxide outlet 175 may be connected to a carbon-dioxide recovery unit 170 via a carbon-dioxide outlet conduit 177. Carbon dioxide that reaches the carbon-dioxide recovery unit 170 may be scrubbed or otherwise recovered for uses outside the demulsification system 100 or may be recycled through a recycle conduit 172 for reuse in further demulsification processing in the demulsification vessel 110. Thus, when carbon dioxide is recycled in the demulsification system, recycled carbon dioxide from the recycle conduit 172 is mixed with carbon dioxide from the carbon-dioxide source 140 and the carbon-dioxide source conduit 142 and flows to the carbon-dioxide mixing zone 145 through the carbon-dioxide injector conduit 143.

As noted above, the demulsification vessel 110 of FIG. 1 contains the initial mixture 5. In the methods for demulsifying an emulsified petroleum source having a predetermined resin-to-asphaltene ratio without substantial aggregation or precipitation of asphaltenes, to be described in greater detail below, the initial mixture may be stabilized to facilitate rupture of the resin-supplemented emulsion of the initial mixture. Rupture of the resin-supplemented emulsion may be followed by formation of a phase-separated mixture. Referring to FIG. 2, in which several components of the demulsification system 100 of FIG. 1 have been omitted for clarity of discussion only, the demulsification vessel 110 of FIG. 2 contains such a phase-separated mixture.

The phase-separated mixture may include a separated aqueous phase 10 and a separated oil phase 30. The separated aqueous phase 10 may contain water, aqueous carbon dioxide, and carbon dioxide dissociated into protons and bicarbonate ions. The separated oil phase 30 may contain emulsion-free oil and some amount of carbon dioxide. The phase-separated mixture may also include a mixed phase 20 between the separated aqueous phase 10 and the separated oil phase 30. The mixed phase 20 may contain an oil-in-water emulsion or a water-in-oil emulsion of hydrocarbon components of the emulsified petroleum source, water, aqueous carbon dioxide, and carbon dioxide dissociated into protons and bicarbonate ions. The separated aqueous phase 10 may meet the mixed phase 20 at an aqueous-phase boundary 15. The separated oil phase 30 may meet the mixed phase 20 at an oil-phase boundary 25. In some embodiments, the inlet-opening height h may be fixed such that the inlet opening 148 is disposed in the expected position of the mixed phase 20 during phase separation, particularly, above the aqueous-phase boundary 15.

The phase-separated mixture may also include a carbon-dioxide phase 40 above the separated oil phase 30. The carbon-dioxide phase 40 may consist essentially of subcritical or supercritical carbon dioxide. The carbon-dioxide phase 40 may meet the separated oil phase 30 at a carbon-dioxide phase boundary 35. In some embodiments, the oil-phase outlet 165 may be positioned on the demulsification vessel 110 at an expected position of the separated oil phase 30 so as to facilitate removal of the separated oil phase 30 from the demulsification vessel 110. Likewise, in some embodiments, the carbon-dioxide outlet 175 may be positioned on the demulsification vessel 110 at an expected position of the carbon-dioxide phase 40 to facilitate removal of the carbon-dioxide phase 40 from the demulsification vessel 110.

It should be understood that the demulsification system 100 of FIGS. 1 and 2 has been described with reference to only the components that are of particular relevance to the methods for demulsifying an emulsified petroleum source about to be described. It should be further understood by the skilled person that the demulsification system 100 of FIGS. 1 and 2 likely will be implemented using appropriate fluidic connections such as pipings, fittings, valves, and the like, and that transfer of fluids within the demulsification system 100 may require pressure or transfer apparatus, pumps, system monitors, pressure gauges, temperature monitors, and the like, that are not shown in FIGS. 1 and 2.

An exemplary embodiment of a demulsification system 100 has been described above with reference to FIGS. 1 and 2. Embodiments of methods for demulsifying an emulsified petroleum source having a predetermined resin-to-asphaltene ratio without substantial aggregation or precipitation of asphaltenes will now be described in detail, with occasional reference to components of the exemplary embodiment of the demulsification system 100 described above.

The methods for demulsifying an emulsified petroleum source having a predetermined resin-to-asphaltene ratio without substantial aggregation or precipitation of asphaltenes may include adding a resin supplement to the emulsified petroleum source to form a resin-supplemented emulsion having a resin-to-asphaltene ratio above a predetermined critical value. According to various embodiments, the emulsified petroleum source may be any crude oil, shale oil, or any crude-oil fraction that is present in an oil-in-water or a water-in-oil emulsion. The resin supplements, to be described in greater detail below, are additives that have a higher resin-to-asphaltene ratio than that of the emulsified petroleum source. It is believed that setting the resin-to-asphaltene ratio of the resin-supplemented emulsion to be above the predetermined critical value may facilitate or result in maintenance of asphaltene suspension during the demulsification process in the resin-supplemented emulsion, in the initial mixture, in the phase-separated mixture, and in the separated oil phase removed from the phase-separated mixture. The concept of resin-to-asphaltene ratios ($R/A_s$) generally will now be described.

Crude oil, and also many petroleum fractions derived from crude oil, may be generally understood as containing multiple hydrocarbon components. By a common analytical method known as SARA, the multiple hydrocarbon components are typically classified in one of four categories based on polarizability and polarity: saturate (S), aromatic (A), resin (R), or asphaltene ($A_s$). The resin-to-asphaltene ($R/A_s$) ratio is the ratio of the total weight of resin (R) components to the total weight of asphaltene ($A_s$) components in the petroleum source.

In petroleum sources such as crude oil, the saturate (S) components are generally nonpolar molecules and include saturated hydrocarbons that may be linear, branched, or cyclic. Crude oils from around the world may contain from about 15 wt. % to as much as about 85 wt. % saturate (S) components, for example. These components are also generally known as paraffins. The aromatic (A) components contain one or more aromatic rings and are slightly more polarizable than the saturate (S) components. Crude oils from around the world may contain from about 10 wt. % to about 45 wt. % aromatic (A) components.

The resin (R) components and the asphaltene ($A_S$) components of petroleum sources typically have numerous cyclic moieties and/or aromatic rings but also contain polar substituents such as carboxylate groups. Molecular weights of resin (R) components and asphaltene ($A_s$) components may vary, but typically the asphaltenes are the largest components of crude oil by molecular weight, with individual asphaltene molecules having mass distributions typically from 400 Dalton to 1500 Dalton. Asphaltenes may also form macromolecules having molecular weights up to 20,000 Dalton or may aggregate to form particles.

By definition, the resin (R) components are distinguished from the asphaltene ($A_s$) components by solubility in various solvents. Particularly, the resin (R) components are defined as the crude oil fraction miscible in light alkanes such as n-pentane, n-hexane, or n-heptane, but insoluble in liquid propane. Resins (R) have also been defined as the petroleum fraction that is strongly adsorbed in surface-active materials such as Fuller's earth, alumina, or silica, such that they can be desorbed only by a solvent such as pyridine or a mixture of toluene and methanol. Crude oils from around the world may contain from about 5 wt. % to about 40 wt. % resin (R) components. Asphaltene ($A_s$) components by definition are insoluble even in excess n-heptane but typically are soluble in benzene or toluene. Crude oils from around the world may contain from nearly 0 wt. % to about 35 wt. % asphaltene ($A_s$) components.

Many analytical protocols for the SARA method are known, whereby relative amounts of the saturate (S), aromatic (A), resin (R) and asphaltene ($A_s$) in a given crude oil or hydrocarbon sample can be determined. For example, a crude oil or hydrocarbon sample may be subjected to a thin-layer chromatography with flame-ionization detection (TLC-FID) protocol such as the standard Iatroscan™ TLC-FID technique IP-143. According to IP-143, a sample is dissolved in a non-polar solvent and injected onto silica rods. The non-polar species (S) and (A) have more affinity for the solvent and move up the rod by capillary action. The rods are placed in a bath containing a polar solvent and the aromatic species (A), which have more affinity for this solvent than the silica, move up the rods. This process is continued until the resins (R) and asphaltenes ($A_s$) are separated. The rods are then placed on a FID scanner to quantify the chromatography. The separation of the class components into the (S), (A), (R), and ($A_s$) fractions, as evidenced through integration of chromatographic peaks in the output of the FID scanner, provide a bulk composition of the sample in weight percentages of the particular component S, A, R, or $A_s$, based on the total weight of the sample. In some embodiments of the methods for demulsifying an emulsified petroleum source, when a SARA analysis of relative weight amounts of petroleum fractions is required, unless stated otherwise, the SARA analysis may be performed according to the IP-143 standard.

Asphaltene content ($A_s$) and resin-to-asphaltene ($R/A_s$) ratio may vary significantly in petroleum sources such as crude oil or shale oil, depending on the location from which the petroleum source is derived. For example, crude oil known as "Arab Heavy" may contain about 6.7 wt. % asphaltene and may have an $R/A_s$ ratio of about 1.12. Crude oil known as "B6" may contain about 13.1 wt. % asphaltene and may have an $R/A_s$ ratio of about 0.92. Crude oil known as "Canadon Seco" may contain about 7.5 wt. % asphaltene and may have an $R/A_s$ ratio of about 1.19. Crude oil known as "Hondo" may contain about 14.8 wt. % asphaltene and may have an $R/A_s$ ratio of about 1.39.

The SARA analysis of crude oils or crude-oil fractions may additionally be used to predict the refractive index (RI) of crude oils or crude-oil fractions. For example, it is believed that the refractive index as related to SARA analysis of crude oils or crude-oil fractions may be described using Equation (1):

$$(RI)=1.524412-0.0008515(S)-0.0002524(A)+0.0016341(R)+0.0013928(A_s) \quad (1)$$

In Equation (1), the values S, A, R, and $A_s$ are the weight fractions of saturate, aromatic, resin, and asphaltene, respectively. Typical crude oils and crude-oil fractions may have refractive indices ranging from about 1.30 to about 1.60. Consistent with Equation (1), crude oils or crude-oil fractions having a high resin or asphaltene content tend to have higher refractive index than crude oils or crude-oil fractions having a low resin or asphaltene content. Without intent to be bound by theory, it is believed that refractive index of a crude oil or a crude-oil fraction is related to the density of the crude oil or crude-oil fraction and that density of a first crude oil or crude oil fraction can be predictive of solubility or miscibility of the first crude oil or crude oil fraction in a second crude oil or crude oil fraction. As such, it is further believed that by closely matching refractive indices of separate crude oils or crude oil fractions, such as within ±5%, ±1%, ±0.5%, ±0.1%, or ±0.01%, compositions with different SARA component ratios may be identified that will have predictably similar densities and, therefore, predictable likelihoods of being soluble in or miscible with each other.

Further with regard to refractive index of crude oil or crude oil fractions, models have been developed that predict whether the asphaltene ($A_s$) components will be stable in solution or will be likely to agglomerate or precipitate out of solution, thereby causing fouling or deposition problems. The models postulate that there exists an onset asphaltene precipitation refractive index P for every particular crude oil or crude oil fraction, such that if asphaltenes are added to the crude oil or crude oil fraction until the refractive index is at or below the onset asphaltene precipitation refractive index P, asphaltenes will begin to agglomerate or precipitate out of solution. An asphaltene stability Δ(RI) may predict the likelihood of whether asphaltenes will be stable in a given crude oil, crude oil fraction, or mixture thereof. The asphaltene stability Δ(RI) is simply the difference between the refractive index $(RI)_{OIL}$ of the crude oil, crude oil fraction, or mixture thereof and the onset asphaltene precipitation refractive index P of the crude oil, crude oil fraction, or mixture thereof. This difference is provided in Equation (2):

$$\Delta(RI)=(RI)_{OIL}-P \quad (2)$$

It is believed that compositions having an asphaltene stability Δ(RI) greater than 0.060 are most likely to have stable asphaltenes, that compositions having an asphaltene stability Δ(RI) less than 0.045 are least likely to have stable asphaltenes, and that compositions having an asphaltene stability between 0.045 and 0.060 are in a border region between stable and likely to have agglomeration or precipitation problems.

In the methods for demulsifying an emulsified petroleum source having a predetermined resin-to-asphaltene ratio without substantial aggregation or precipitation of asphaltenes, a resin supplement may be added the emulsified petroleum source to form a resin-supplemented emulsion having a resin-to-asphaltene ratio above a predetermined critical value. The emulsified petroleum source may be a crude oil that is in an oil reservoir or has been recovered from an oil well or oil reservoir as an oil-in-water emulsion or as a water-in-oil emulsion. In some embodiments, the emulsified petroleum source may have an oil temperature of less than 250° C. If the oil temperature is above 250° C. initially, the methods for demulsifying the emulsified petroleum source may include cooling the emulsified petroleum source to below 250° C. by any practical method. The emulsified petroleum source may have been found, discovered, or recovered in emulsified form or may be a crude oil that has been made into an emulsion for purposes of recovery. In some embodiments, the emulsified petroleum source may be a heavy crude oil having a high viscosity or may be a crude oil that has a high asphaltene content such as greater than 5 wt. %, greater than 10 wt. %, or greater than 15 wt. %, as measured by SARA analysis or similar technique. The resin-to-asphaltene ratio of the emulsified petroleum source may be predetermined in advance of the demulsification process by the SARA analysis or similar technique.

The resin supplement is then added to the emulsified petroleum source. In some embodiments, the resin supplement is chosen based on considerations of solubility and miscibility of the resin supplement in the emulsified petroleum source. As described above, solubility and miscibility may be related to refractive index. Thus, in some embodiments, the resin supplement may be chosen such that the resin supplement has a closely matched refractive index to the refractive index of the emulsified petroleum source, particularly of the non-aqueous portion of the emulsified petroleum source. In exemplary embodiments, the refractive indices of the resin supplement and the emulsified petroleum source may be matched to within ±5%, ±1%, ±0.5%, ±0.1%, or ±0.01%. Illustrative, non-limiting examples of resin supplements include Coker gas oil, Visbreaker oil, light cracked distillates, and medium cracked distillates. Further illustrative, non-limiting examples of resin supplements may include liquefied lignin components, including those derived from natural sources, such as vanillin and lignin sulfonates.

In some embodiments, the methods for demulsifying an emulsified petroleum source having a predetermined resin-to-asphaltene ratio without substantial aggregation or precipitation of asphaltenes may be carried out in a refinery setting, in which a particular type of crude oil may be processed at a certain time. Some portions of the particular type of crude oil may be undergoing demulsification while other portions of the particular type of crude oil are already undergoing later processing stages such as cracking or fractionation. Thus, in such embodiments, the resin supplement may be a petroleum fraction derived from the same crude oil present in the emulsified petroleum source, provided the resin supplement contains resinous materials with refractive indices that closely match the refractive index of the crude oil in the emulsified petroleum source to facilitate solubility and miscibility.

In one exemplary refinery configuration, crude oil may be fractionated in an atmospheric column, for example. The atmospheric bottom may be fed to a vacuum distillation where further fractionation is carried out. During these processes, the asphaltene ($A_s$) and resin (R) fractions, which have the highest boiling points of the SARA components in the crude oil, are left behind in the vacuum bottoms after the saturates (S) and aromatics (A) boil off. The asphaltene ($A_s$) and resin (R) fractions on the bottoms of the vacuum distillation unit may be deasphalted, whereby the asphaltenes are removed by a solvent deasphalting process also known as carbon rejection. The deasphalted oil from this unit contains a high weight percent of resin (R). The deasphalted oil may then be subjected to Fluidized Catalytic Cracking (FCC) or other cracking processes to form a "light cycle oil" (LCO) or a "heavy cycle oil" (HCO). Because the LCO or HCO formed in this manner contains resin (R) components derived from a particular crude oil source, if identified as having a refractive index about equal to or greater than that of the original crude oil, the LCO or HCO may be particularly well suited for use as the resin supplement in the method for demulsifying the emulsified petroleum source. Alternatively, light cracked distillates, medium cracked distillates, or mixtures thereof formed by subjecting the deasphalted oil to thermal cracking or Visbreaking may also be suitable for use as the resin supplement in the method for demulsifying the emulsified petroleum source.

In embodiments of the methods for demulsifying an emulsified petroleum source having a predetermined resin-to-asphaltene ratio without substantial aggregation or precipitation of asphaltenes, once a suitable resin supplement having a similar refractive index to the crude oil portion of the emulsified petroleum source is identified, a critical value may be determined for a mixture of the resin supplement with the emulsified petroleum source to form a resin-supplemented emulsion. The critical value represents a resin-to-asphaltene ratio of the resin-supplemented emulsion, at or below which asphaltenes are expected to be unstable and may agglomerate or precipitate during the demulsification process. In general, further addition of the resin supplement to the emulsified petroleum source raises the $R/A_s$ ratio of the resin-supplemented emulsion, because the emulsified petroleum source will typically have a lower $R/A_s$ ratio than that of the resin supplement.

In some embodiments, the methods for demulsifying an emulsified petroleum source having a predetermined resin-to-asphaltene ratio without substantial aggregation or precipitation of asphaltenes may include analyzing the emulsified petroleum source before adding the resin supplement to determine an amount of resin supplement required to be added to the emulsified petroleum source to attain a resin-to-asphaltene ratio of the supplemented emulsion above the predetermined critical value of the resin-to-asphaltene ratio. To determine the critical value, the $R/A_s$ ratios of the identified resin supplement and of the crude oil component of the emulsified petroleum source may be calculated using an analytical protocol such as SARA analysis. Refractive indices of the identified resin supplement and of the crude oil component of the emulsified petroleum source may be determined by known analytical techniques or may be estimated by calculation from the SARA analysis using Equation (1) above. The onset asphaltene precipitation refractive index $P_{OIL}$ of the crude oil may also be determined experimentally. Applying Equation (2), the critical value for the resin-supplemented emulsion is the $R/A_s$ ratio that corresponds to a refractive index $(RI)_{MIX}$ of the resin-supplemented emulsion that satisfies the relationship $(RI)_{MIX}-P_{MIX}>0.060$.

When the emulsified petroleum source and the resin supplement are mixed to form the resin-supplemented mixture, both the onset of precipitation ($P_{MIX}$) and the refractive index $(RI)_{MIX}$ of the mixture are typically lower than $P_{OIL}$ and $(RI)_{OIL}$, respectively. It is also believed that generally $(RI)_{OIL}-(RI)_{MIX}>P_{OIL}-P_{MIX}$. As such, given the SARA compositions of both the crude oil and the resin supplement, Equation (1) may be used to determine an approximate weight ratio of crude oil to resin supplement that increases the refractive index $(RI)_{OIL}$ of the crude oil to above $0.060+P_{OIL}$. Once such an approximation is made, the actual weight ratio of emulsified petroleum source to resin supplement necessary to result in the relationship $(RI)_{MIX}-P_{MIX}>0.060$ may be determined from calibration curves of $P_{MIX}$ with respect to weight ratio of resin supplement, or by any other suitable experimental protocol. By such a calculation, as an illustrative example, it may be determined that for a particular crude oil source and a chosen resin supplement, a resin-supplemented emulsion may be prepared by adding 1 parts by weight resin supplement to 10 parts by weight crude oil to raise the refractive index of the crude oil sufficiently, such that the refractive index of the resin-supplemented emulsion is greater than the onset asphaltene precipitation refractive index $P_{MIX}$ of the resin-supplemented emulsion by at least 0.060. In this regard, adding the resin supplement to the emulsified petroleum source to form a resin-supplemented emulsion having a resin-to-asphaltene ratio above a predetermined critical value, according to various embodiments, may include adding a predetermined amount of the resin supplement to a predetermined amount of the emulsified petroleum source, such that the weight ratio of the resin supplement to the emulsified petroleum source results in the resin-supplemented emulsion having a resin-to-asphaltene ratio greater than the onset asphaltene precipitation refractive index $P_{MIX}$ of the resin-supplemented emulsion by at least 0.060.

Thus, in some embodiments, the methods for demulsifying an emulsified petroleum source may include determining the amount of resin supplement required to be added to the emulsified petroleum source to attain a resin-to-asphaltene ratio of the supplemented emulsion above the predetermined critical value of the resin-to-asphaltene ratio. Determining the amount of resin supplement may include determining a crude-oil refractive index $(RI)_{OIL}$ of the crude oil, determining a precipitation-onset refractive index (P) of the crude oil, at which asphaltene precipitation occurs, determining a supplement refractive index $(RI)_{RS}$ of the resin supplement, and determining a stabilizing amount of resin supplement required to be added to the emulsified petroleum source to provide a stability refractive index difference $\Delta(RI)>0.060$ for the resin-supplemented emulsion, where $\Delta(RI)=(RI)_{MIX}-P$ and $(RI)_{MIX}$ is a mixture refractive index of the resin-supplemented emulsion.

The methods for demulsifying an emulsified petroleum source having a predetermined resin-to-asphaltene ratio without substantial aggregation or precipitation of asphaltenes may include adjusting an acidic-to-basic ratio (A/B) of acidic functional groups to basic functional groups in the resin-supplemented emulsion, such that A/B is from about 0.25 to about 4.0, such as from about 0.5 to 2.0, for example. Crude oils in general may be characterized as having an acid number (AN) and a base number (BN). The AN and BN values respectively measure the concentration of acidic and alkaline constituents of the crude oil. Both acidic and alkaline constituents can exist in crude oil at the same time. For example, as described above, the asphaltene components of crude oil may include acidic groups such as carboxylic acids and naphthenic acids. The asphaltene components, as well as other components of the crude oil, may include basic groups, often found on organic nitrogen or sulfur heterocyclic moieties such as pyrrolic groups, pyridinyl groups, indoles, carbazoles, thiophenes, and benzothiophenes. The AN and BN values do not indicate the strength of the acidic or alkaline constituents in the crude oil.

Acid number may be measured using standard protocols such as ASTM D664, ASTM D974, ASTM D1534, or ASTM D3339, for example. Base number may be measured using standard protocols such as ASTM D974, ASTM D2896, or ASTM D4739, for example. As used herein, the acidic-to-basic ratio (A/B) of acidic functional groups to basic functional groups in the resin-supplemented emulsion is equal to AN/BN for the resin-supplemented emulsion, both AN/BN being measured by a standard protocol including, but not limited to, the ASTM standards noted above.

In some embodiments, the adjusting of acidic-to-basic ratio (A/B) of the resin-supplemented emulsion to from about 0.25 to about 4.0, such as from about 0.5 to 2.0, may include adding an acidic additive to the supplemented emulsion to raise the acidic-to-basic ratio or adding additional resin supplement or a basic additive to the supplemented emulsion to lower the acidic-to-basic ratio. Thus, in some embodiments, the methods for demulsifying the emulsified petroleum source may include measuring the A/B ratio of the resin-supplemented emulsion, choosing an acidic additive or a basic additive, determining an additive amount of the additive to be added to the resin-supplemented emulsion to result in an A/B ratio of the resin-supplemented emulsion of from about 0.25 to about 4.0 or from about 0.5 to 2.0, and adding the additive amount of the acidic additive or basic additive to the resin-supplemented emulsion.

In exemplary embodiments, acidic additives may be chosen from crude sources with higher A/B ratios than that of the resin-supplemented emulsion or from organic acids such as citric acid, succinic acid, acetic acid, or naphthenic acids. In exemplary embodiments, basic additives may be chosen from crude sources with lower A/B ratios than that of the resin-supplemented emulsion, such as resin fractions containing resin molecules with basic functional groups. The basic additives may also be chosen from organic bases, for example, nitrogen or sulfur heterocyclic bases such as carbazoles, anilines, quinolines, thiophenes, or benzothiophenes. The organic bases themselves may be derived or extracted from various crude oil fractions.

With some selections of the acidic additive or the basic additive used to adjust the A/B ratio of the resin-supplemented emulsion, the adjustment of A/B ratio may affect the $R/A_s$ ratio and/or the critical value of the resin-supplemented emulsion. In such cases, adjustment of the A/B ratio of the resin-supplemented emulsion must be performed with due care to ensure that the $R/A_s$ ratio of the resin-supplemented emulsion remains above the critical value. In some embodiments, if any acidic or basic additive need be added in an amount that would lower the $R/A_s$ ratio below the critical value, the methods may further include addition additional resin supplement to maintain the $R/A_s$ ratio of the resin-supplemented emulsion above the critical value.

Once the resin-supplemented emulsion is formed and has both a $R/A_s$ ratio above the predetermined critical value and an A/B ratio of from about 0.25 to about 4.0, the resin-supplemented emulsion may be contacted with carbon dioxide to form an initial mixture. In some embodiments, the carbon dioxide may be chosen from a subcritical liquid carbon dioxide or a supercritical carbon dioxide. Carbon dioxide behaves a supercritical fluid when its temperature is above 30.98° C. and its pressure is above 73.77 bar. In various embodiments, depending whether the carbon dioxide is to be present as a subcritical liquid or as a supercritical fluid, the contacting of the carbon dioxide with the resin-supplemented emulsion may be performed at a system pressure of from about 1 bar to about 300 bar. The contacting of the carbon dioxide with the resin-supplemented emulsion may be performed at a system temperature of up to a maximum of about 100° C., or up to about 50° C. The minimum system temperature if supercritical carbon dioxide is desired is the supercritical temperature of the carbon dioxide at the system pressure. The minimum system temperature is subcritical carbon dioxide is desired is the freezing or sublimation temperature of the carbon dioxide at the system pressure.

When the initial mixture is formed, the initial mixture may contain an emulsified oil phase and an emulsified aqueous phase, both being remnant from emulsified petroleum source and including the resin supplement that was added to set the $R/A_s$ ratio of the resin-supplemented mixture. The initial mixture may then be stabilized to facilitate rupture of the resin-supplemented emulsion. In some embodiments, stabilization of the initial mixture may include light to moderate mixing or agitation of the initial mixture to facilitate an onset of coalescence of the emulsified oil phase, the emulsified aqueous phase, or both. In other embodiments, stabilization of the initial mixture may include allowing the initial mixture to remain undisturbed for a period of time sufficient for the onset of coalescence. In particular, coalescence of a dispersed phase within a continuous phase of the initial mixture occurs. In an oil-in-water emulsion, for example, the emulsified oil phase is the dispersed phase and the emulsified aqueous phase is the continuous phase. Likewise, in a water-in-oil emulsion, the emulsified aqueous phase is the dispersed phase and the emulsified oil phase is the continuous phase.

The stabilization of the initial mixture and onset of coalescence of the dispersed phase may lead to formation of a phase-separated mixture. The phase-separated mixture may contain at least a separated aqueous phase and a separated oil phase. The phase-separated mixture may additionally contain a gas phase above the separated oil phase and a mixed phase above the separated aqueous phase and below the separated oil phase. The gas phase may contain or consist essentially of subcritical or supercritical carbon dioxide. The mixed phase may contain portions of the emulsified oil phase and the emulsified aqueous phase of the initial mixture that have not yet phase separated. The separated oil phase may then be removed from the phase-separated mixture. In some embodiments, the carbon dioxide in the gas phase may be captured or may be recycled for use in further demulsification processes.

In some embodiments, the methods for demulsifying an emulsified petroleum source having a predetermined resin-to-asphaltene ratio without substantial aggregation or precipitation of asphaltenes may additionally include monitoring the resin-to-asphaltene ratio, the acidic-to-basic ratio, or both, while the resin-supplemented emulsion is contacted with the carbon dioxide. In such embodiments, if the $R/A_s$ ratio of the initial mixture inside the demulsification vessel is found to be dropping toward the predetermined critical value, or if the A/B ratio of the initial mixture inside the demulsification vessel is found to be dropping or rising outside the range of from 0.25 to 4.0, corrective action may be taken. In particular, the corrective action may include, for example, performing at least one adjustment chosen from: adjusting an amount of resin supplement being added to the emulsified petroleum source to maintain the resin-to-asphaltene ratio of the initial mixture or the phase-separated mixture above the predetermined critical value; or adding organic acid or organic base to the initial mixture or the phase-separated mixture to maintain the acidic-to basic ratio at from about 0.25 to about 4.0. Such in-situ adjustments of $R/A_s$ ratio and/or of A/B ratio may be performed using engineering principles within the grasp of the skilled person and may involve appropriate calculations of volumetric flow rates of the petroleum source, the resin supplement, the acidic or basic additive, or any combination thereof.

In the methods for demulsifying an emulsified petroleum source having a predetermined resin-to-asphaltene ratio according to the embodiments described above, the demulsification progresses without substantial aggregation or precipitation of asphaltenes. Without intent to be bound by theory, it is believed that the resin-to-asphaltene ratio being above the predetermined critical value in the supplemented emulsion may play a major role in maintaining asphaltene suspension in all stages of the demulsification process, particularly in the resin-supplemented emulsion, in the initial mixture, in the phase-separated mixture, and in the separated oil phase removed from the phase-separated mixture. It is also believed that the adjustment and/or maintenance of acidic-to-basic functional group (A/B) within the range of from about 0.25 to about 4.0 also stabilizes asphaltenes, such that asphaltene agglomeration and precipitation are avoided during the demulsification process.

Further details of the theory involved with the methods for demulsifying an emulsified petroleum source, according to embodiments herein, will now be described. It should be understood that the theoretical discussions that follow are intended to clarify various aspects of the embodiments of the methods described herein, not to limit them.

During the demulsifying process, $CO_2$ is believed to play a dual role. In addition to assisting with the solvation of asphaltenes, the supercritical $CO_2$ also diffuses through the crude-oil phase of a water-in-oil emulsion, or through the aqueous phase of an oil-in-water emulsion due to better diffusivity, zero surface tension, and lower viscosity, thereby initiating mass transfer of target compounds.

The system pressure at subcritical to supercritical ranges creates a wide array of lower pH environments that interactively deactivate the acidic properties of the carboxylic groups of the asphaltenes, resin acids, naphthenic acid groups at the o/w or w/o interface. With this deactivation, the interaction between the acid groups present in oil molecules and hydrogen bonds of water are deactivated or diminished when the pH of the aqueous phase drops below the $pK_a$ (acid dissociation constant) value of the carboxylic acid groups of the oil components. Thus, the interaction between dissociated carboxylic acid groups ($—COO^-$) from the oil phase and water molecules are reverted by associating the organic acid groups ($—COO^-$) with its counter ion ($H^+$) and consequent disengagement of polar acidic group of oil phase and hydrogen bonding in water phase at the emulsion skin interface. At high pressures of 70 atm to 200 atm and temperatures from 25° C. to 70° C., the pH may be from about 2.80 to about 2.95. Therefore, the pH near or at the supercritical range (71 atm and 32° C.) of water in the emulsion is around ~3.00, which is enough to deactivate the indigenous organic acids of the crude oil. Molecules with —COOH groups have much higher $pK_a$ values.

On the other hand, the diffusion of carbon dioxide at the interface of the emulsion reduces the viscosity and density of the emulsion, thereby lowering the interfacial tension at the emulsion skin. By allowing sufficient relaxation time as the emulsion is stabilized, rupture of the emulsion is facilitated by various means including coalescence. The carbon dioxide that has diffused inside the water or at the oil/water (o/w) or water/oil (w/o) interface continuously migrates into the aqueous phase until equilibrium is established, with carbonic acid ($H_2CO_3$) and dissolved $CO_2$ building up in the aqueous phase. Part of the carbon dioxide from the oil interface also establishes equilibria with the water as bicarbonate ($HCO_3^-$) ions are formed. Moreover, carbon dioxide present at the film interface has minimal electrical interaction with the oil phase. As a result, the carbon dioxide creates negative synergy to the o/w or w/o emulsion skin by viscosity reduction and makes the skin elasticity weaker. If adequate time is allowed during the presence of subcritical and supercritical $CO_2$, the relaxation of organic polar groups in oil would take place at the interface of the emulsion film, and film tenacity would weaken.

The lowering of pH in the aqueous phase in the demulsification system causes the resin acids and or naphthenic acids to "switch off" their acidic properties. Namely, protons ($H^+$)

from these acids re-associate with the bicarbonate (—$COO^-$) anions to form the undissociated state (—COOH), because they have higher $pK_a$ value than the pH at the emulsion interface, where protons have been released from carbonic acid ($H_2CO_3$). This occurs as the all the —COOH groups from larger nonpolar (organic) component of the naphthenic acids, resin acids, protoporphyrin and asphaltene become inactive at lower pH. The inactivation may be caused by formation of carbonic acid and its dissociation to release proton ($H^+$) at elevated pressure.

It is believed that the carboxylic acid (R—COOH) components of asphaltene, naphthenic and resin acid present in the emulsion films are one of the primary reasons for developing strong interfacial tension of the films thereby giving them firmness, strength, or tenacity. The formation of $H^+$ ion from the dissociation of R—COOH at the oil water contact region results in the formation of the emulsion interface. At this interface, the organic components of surface active components are pulled by the organic macromolecules of the oil phase by van der Waals attraction (or π-π attraction) from the oil phase in the direction of the oil phase by the other larger macromolecules (asphaltenes). On the other hand, the dissociated $H^+$ ions from the surface active components (e.g., R—COOH) may be attracted toward the water molecules by electrical attraction or coulombic pull toward the aqueous phase. It is believed that this tussle at the w/o or o/w interface with the surface active components at the middle may provide the basis for the development of interfacial film.

The strength of the film also may result from the stack wise deposition of asphaltene molecules at the interface. The carboxylic and other polar groups of asphaltene may also take part in such interaction between the two phases. When the resins are the participating surface active agents, their aromatic counterpart is pulled by the aromatic core of the asphaltenes in the oil phase by π-π attractions. In the case of naphthenic acid, the organic counterpart of is attracted by the van der Waals attraction by the aliphatic components of asphaltene and other organic components. For asphaltenes acting as the surface active agents at the interface, the emulsion becomes rigid and tighter. For example, the aromatic part of the asphaltenes may be pulled by other asphaltenes in the oil phase by π-π attractions, and the aliphatic components of asphaltenes may be pulled by the aliphatic components of resins and asphaltenes present or juxtaposed in the oil phase. It is believed that the relative concentration of oil components, temperature, size, transport properties and its polar groups, may determine the type of oil components that end up at the interfacial skin.

The polar hetero atoms components of asphaltene macromolecules, e.g., S, N, metals, amines may also to some extent contribute to the strength of the emulsion films. These heteroatoms may function similarly to zwitterions predominantly in asphaltene and, to lesser extent, in resins. However, with weakening of the emulsion skin, the heteroatom (S, N, O etc.) containing asphaltenes, porphyrins, and amines in asphaltene and resin would may instead undergo inter and or intra repositioning of the molecules or segments of the macromolecules due to the relaxation of the emulsion skin. As such, the deactivated carboxylic groups (—COOH) would move inside the interior of the oil phase, because the oil phase already lost its ability to interact with the aqueous phase in terms of hydrogen bonding capacity. This repositioning and reorganization of the macromolecules such as asphaltenes may also take place between the oppositely electropositive and electronegative heteroatoms (zwitterions) within or between the macromolecules of asphaltenes, resin and naphthenic acids.

Additionally, changes in the electrokinetic behavior of aggregate-water interactions at the emulsion skins may be controlled by the local pH, formed from the dissociation of carbonic acid ($H_2CO_3$), i.e., formation of $H^+$ and bicarbonate ($HCO_3^-$) ions at the oil-water interface. Thereby, molecules having organic acid (carboxylic) and basic organic groups in oil components, which are responsible for creating the strong emulsions, return to undissociated form by interacting with protons ($H^+$) or hydronium ions ($H_3O^+$). Thus, the carbonic acid may be viewed as a proton pump at the interface, which renders the carboxylic acid (—COOH) groups inactive. As a result, there is a change of the zeta potential (−10 eV to +10 eV) at the interface. That is the isoelectric point (IEP) is reached at the thin films interface. This happens as the pH of the aqueous phase of the emulsion drops below the acid dissociation constant of the organic acids (carboxylic acid of naphthenic, resin and asphaltenes, protoporphyrin) at the interface of the film.

As a result, the hydrophilic lipophilic (HLB) balance or hydrophilic lipophilic difference (HLD) at the film interface may be shifted so that the interfacial tensions of the emulsion films are rendered weaker. These phenomena take place as the zwitterions in the asphaltenes also start to interact within and between them. The acidic groups —$COO^-$ then tend to associate themselves back with their counter ions, $H^+$ ion, resulting in the relaxation at the film surface (present in water) to form charge free —COOH of resin and naphthenic acids along with the acid group of the asphaltene molecules. These effects result in the disappearance of the interaction between water and the polar groups in the oil phase. The acidic-to-basic functional group ratio between 0.25 and 4.0 may effectively minimize the zeta potential to the desired range.

When this is achieved, mild mixing of the emulsion system can induce coalescence of the emulsions and, consequently, the size of the emulsions would increase. The rupture of the interfacial films during the coalescence helps the emulsion droplets to grow. As the droplets reach a critical size, gravity assists the separation of the oil and water fractions while the coalescence continues.

Therefore, the pressurized subcritical and supercritical carbon dioxide act as a proton pump and viscosity reducer during the demulsification. This may be facilitated by addition of solvating agents, such as resin supplement, to prevent asphaltene precipitation. The aromatic resin to asphaltene ratio above a critical value may ensure the solvation of asphaltene molecules, thereby preventing asphaltene aggregation and precipitation. The addition of resin supplement also helps thinning of the interfacial skin and lowers skin rigidity to allow for coalesce of the emulsion droplets into larger ones. The aromatic resin to asphaltene ratio also may be fixed such that the resins help arrange the zwitterion containing asphaltenes molecules to assume a micelle/vesicle like structure, and/or a colloidal suspension, and/or a molecular solution utilizing the oppositely charged polar groups and/or aromatic solvating characteristics present in both constituents.

When such a micelle/vesicle formation is initiated, the chance of asphaltene aggregation diminishes significantly. Namely, the weakened interfacial tensions on the emulsion interface with mild agitation starts breaking apart and coalescing to form larger droplets. Consequently, when the sizes reach a critical range, gravitational force allows the droplets to settle at the bottom of the demulsification vessel, and phase separation takes place between oil and the aqueous phase.

Figure 3A:
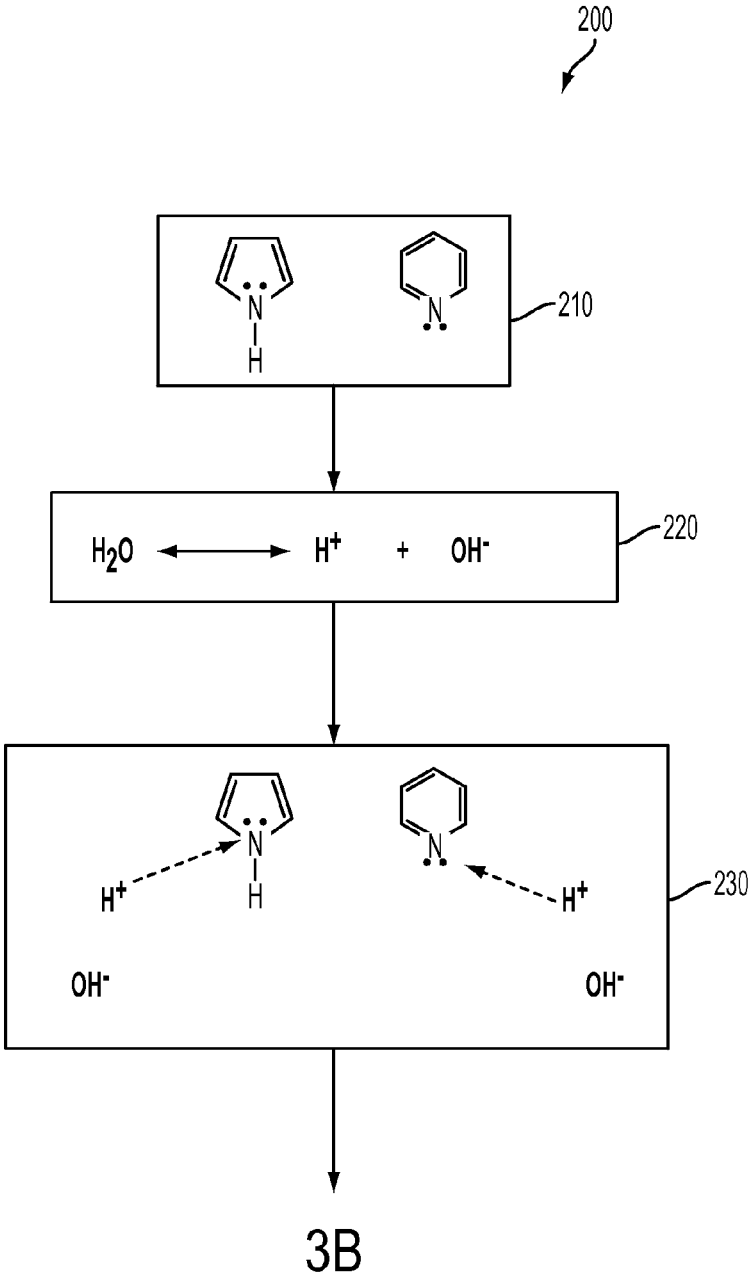
FIG. 3A is a diagram of the propagation of various species in solution and their relationship to organic heterocycles during demulsification of petroleum by methods according to embodiments herein.
Figure 3B:
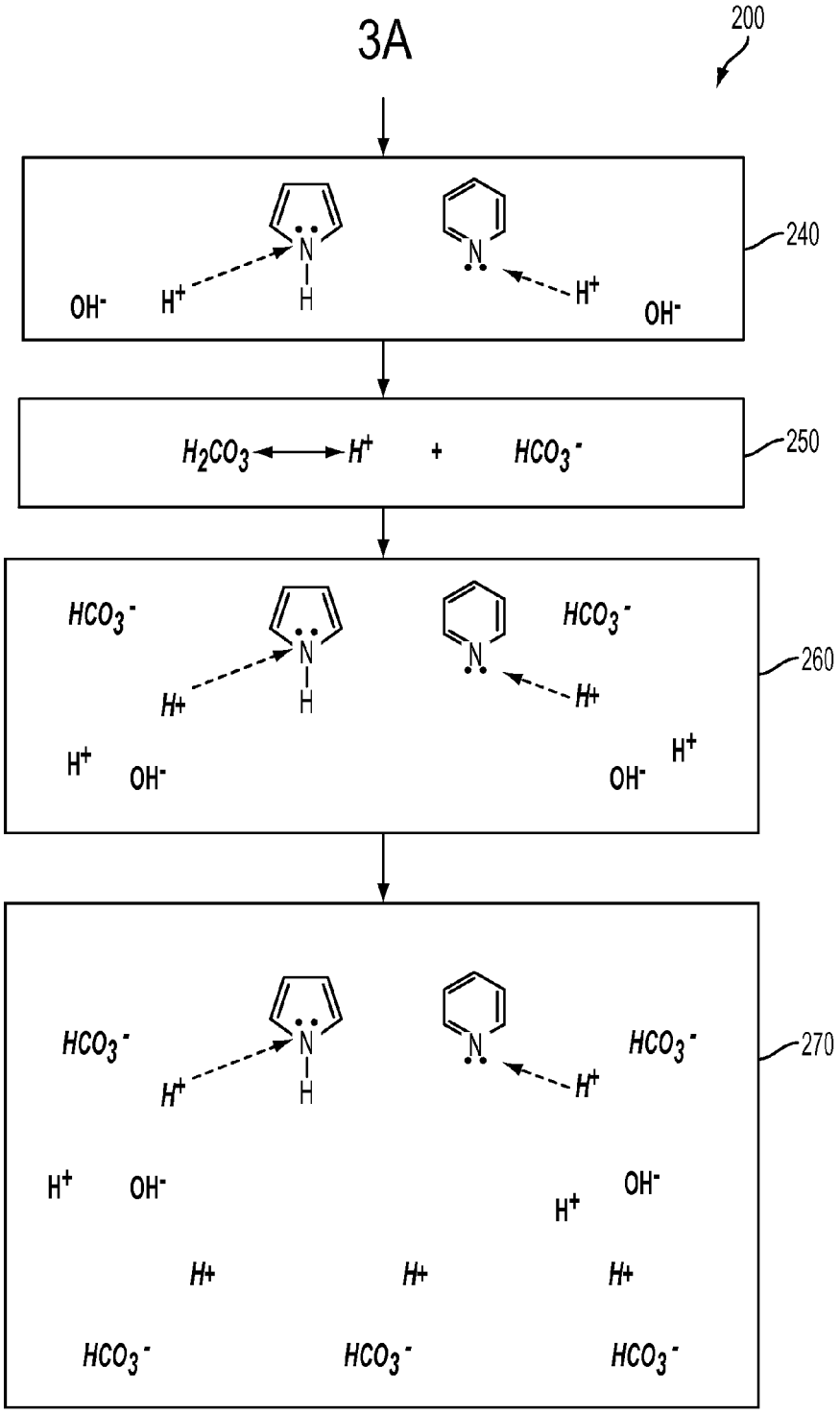
FIG. 3B is a continuation of the diagram of FIG. 3A.

Referring to FIGS. 3A and 3B as illustrative of an organic nitrogen proton association process 200 that may occur in the emulsions during demulsification, some of the basic crude oil which contains pyrrole and pyridine groups in their resin and asphaltene structures can also participate in forming w/o or o/w emulsions. In FIG. 3A, at step 210, the structures of pyrrole (left) and pyridine (right) are shown. Both pyrrole and pyridine include a lone pair of electrons. Water dissociation into protons and hydroxide is shown at step 220. As illustrated at step 230, when the pyrrole and/or pyridines are in water, they have the tendency to bind with $H^+$ ions from the water, thereby leaving the $OH^-$ ions from the water still lurking in the water phase. As a result, the organic nitrogen containing groups can also create films on the oil/water interface of the emulsion. The strength of such a film depends on two parameters. The first parameter is the basicity of the organic nitrogen, and the second parameter is the size of the associated organic counterpart of the groups in the oil phase. It is important to understand that the lone pair electrons are very receptive toward accepting protons. The coulombic pull between the proton attached to the organic nitrogen-containing pyrrole and pyridine groups and the $OH^-$ of the aqueous phase causes increased concentration of amphiphiles from the oil phase to gather at the oil/water interface, resulting in the formation of interfacial skins.

At this point, due to comparatively smaller size of the resin molecules, the resin molecules tend to rush to the o/w or w/o interface. However, depending on the resin-to-asphaltene ratio of the emulsion, some asphaltenes may also arrive at the interface. Then, the functional groups such as carboxylic acids or organic nitrogens interact with the water molecules, while their hydrophobic amphiphiles remain in the oil phase. In all cases, some of the asphaltene molecules and, in some cases, wax particles also stack up over resin and asphaltenes, thereby tightening the emulsion skin interface.

In FIG. 3B, at step 240 the pyrrole and pyridine in water are shown with their tendency to bind with $H^+$ ions from the water while the $OH^-$ ions from the water remain free in the aqueous phase. At step 250, high pressure $CO_2$ is introduced or charged into the emulsion, whereby in the aqueous phase, the carbonic acid ($H_2CO_3$) dissociates to $HCO_3^-$ and $H^+$ ions. As shown at step 260, the $H^+$ ions are attracted to the lone-pair electrons of the organic nitrogen groups. When this happens, the organic N containing groups gradually lose their basic properties. Furthermore, the counterion $OH^-$ produced by dissociation of water in step 220 ion may be neutralized or solvated by the dissociated $H^+$ ions. However at step 270, with the increased concentration of $H^+$ ions derived from carbonic acid, the pH of the system drops, the emulsion interface becomes weaker, and the concentration of $OH^-$ reduces. With the diminishing $OH^-$ ion concentration and increasing H+ ion concentration from the carbonic acid ($H_2CO_3$), the pH in the aqueous phase drops inside the emulsion. This may result in an overall weakening of the emulsion interface. With mild agitation, such weakened emulsions are easy to coalesce. Once this process is continued, the droplets gets larger in size, and eventually phase separation take place due to the action of gravitational force on the larger droplets. However, in order to avoid asphaltene precipitation, the aromatic resin to asphaltene should be maintained by adding aromatic resinous material to keep the larger asphaltene macromolecules solvated and prevent them from stacking over each other.

Thus, embodiments of methods for demulsifying an emulsified petroleum source having a predetermined resin-to-asphaltene ratio without substantial aggregation or precipitation of asphaltenes have been described. According to the various embodiments, demulsification of the petroleum source in the presence of subcritical or supercritical carbon dioxide is carried out by maintaining a resin-to-asphaltene ratio of the emulsion greater than a critical value at which asphaltenes may be expected to agglomerate or precipitate. Furthermore, the acidic-to-basic functional group ratio is maintained within a range that also works to prevent asphaltene agglomeration and/or precipitation. In particular, the resin-to-asphaltene ratio of the emulsion may be adjusted upwardly to above the critical value by using resin fractions that may be readily available, particularly if the demulsification process is performed in a refinery setting. Avoidance of asphaltene agglomeration and precipitation during demulsification eliminates fouling and clogging problems that may typically result when the demulsification process is desired before a crude oil is desalted. Thereby, the methods according to embodiments herein also open additional options for processing crude-oil emulsions even prior to any desalting process to remove asphaltenes entirely.

It should be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A method for demulsifying an emulsified petroleum source having a predetermined resin-to-asphaltene ratio without substantial aggregation or precipitation of asphaltenes, the method comprising:

adding a resin supplement to the emulsified petroleum source to form a resin-supplemented emulsion having a resin-to-asphaltene ratio above a predetermined critical value;

adjusting an acidic-to-basic ratio of acidic functional groups to basic functional groups in the supplemented emulsion to be from about 0.25 to about 4.0;

contacting the resin-supplemented emulsion with carbon dioxide to form an initial mixture, the initial mixture having an emulsified oil phase and an emulsified aqueous phase, the carbon dioxide being chosen from subcritical carbon dioxide or supercritical carbon dioxide;

stabilizing the initial mixture to facilitate rupture of the resin-supplemented emulsion;

forming a phase-separated mixture from the initial mixture, the phase-separated mixture comprising a separated aqueous phase and a separated oil phase; and removing the separated oil phase from the phase-separated mixture, wherein the resin-to-asphaltene ratio being above the predetermined critical value in the resin-supplemented emulsion maintains asphaltene suspension in the resin-supplemented emulsion, the initial mixture, the phase-separated mixture, and the separated oil phase removed from the phase-separated mixture.

2. The method of claim 1, wherein the emulsified petroleum source is an oil-in-water emulsion or a water-in-oil emulsion.

3. The method of claim 1, wherein the resin supplement is chosen from Coker gas oil, Visbreaker oil, liquefied lignin components, vanillin, lignin sulfonates, and light cracked distillates, and medium cracked distillates [Heavy naphtha].

4. The method of claim 1, wherein the emulsified petroleum source comprises crude oil.

5. The method of claim 1, wherein adjusting the acidic-to-basic ratio comprises adding an organic acid to the supplemented emulsion to raise the acidic-to-basic ratio or adding additional resin supplement or an organic base to the supplemented emulsion to lower the acidic-to-basic ratio.

6. The method of claim 1, wherein the emulsified petroleum source has an oil temperature of less than 250° C.

7. The method of claim 1, wherein the contacting of the resin-supplemented emulsion with the carbon dioxide is performed in a demulsification vessel or in a petroleum reservoir.

8. The method of claim 7, wherein the contacting of the resin-supplemented emulsion with the carbon dioxide is performed at a system pressure of from 1 bar to 300 bar and at a system temperature from above the supercritical temperature of the carbon dioxide to about 100° C.

9. The method of claim 8, wherein the system temperature is from above the supercritical temperature of the carbon dioxide to about 50° C.

10. The method of claim 1, further comprising:

analyzing the emulsified petroleum source before adding the resin supplement to determine an amount of resin supplement required to be added to the emulsified petroleum source to attain a resin-to-asphaltene ratio of the supplemented emulsion above the predetermined critical value of the resin-to-asphaltene ratio; and analyzing the emulsified petroleum source before adjusting the acidic-to-basic ratio to determine an amount of organic acid, organic base, or additional resin supplement required to be added to the emulsified petroleum source to attain the acidic-to-basic ratio of the supplemented emulsion of from about 0.25 to about 4.0.

11. The method of claim 10, wherein determining the amount of resin supplement required to be added to the emulsified petroleum source further comprises:

determining a crude-oil refractive index $(RI)_{OIL}$ of the crude oil;

determining a precipitation-onset refractive index (P) of the crude oil, at which asphaltene precipitation occurs;

determining a supplement refractive index $(RI)_{RS}$ of the resin supplement;

determining a stabilizing amount of resin supplement required to be added to the emulsified petroleum source to provide a stability refractive index difference $\Delta(RI) > 0.060$ for the resin-supplemented emulsion, where $\Delta(RI) = (RI)_{MIX} - P$ and $(RI)_{MIX}$ is a mixture refractive index of the resin-supplemented emulsion.

12. The method of claim 1, wherein stabilizing the initial mixture comprises agitation of the initial mixture to facilitate the rupture of the resin-supplemented emulsion through coalescence of the emulsified oil phase, the emulsified aqueous phase, or both.

13. The method of claim 1, wherein:

the method is performed in a refinery; and the method further comprises providing the resin supplement from a hydrocracker located in the refinery.

14. The method of claim 1, wherein the emulsified petroleum source comprises crude oil, the method further comprising:

determining a crude-oil refractive index $(RI)_{OIL}$ of the crude oil; and selecting the resin supplement to have a supplement refractive index $(RI)_{RS}$ such that $(RI)_{RS} = (RI)_{OIL} \pm 10\%$.

15. The method of claim 1, wherein the supplemental resin is a cracked fraction of a crude oil, the cracked fraction containing organic heterocyclic groups.

16. The method of claim 1, further comprising monitoring the resin-to-asphaltene ratio, the acidic-to-basic ratio, or both while the resin-supplemented emulsion is contacted with carbon dioxide; and performing at least one adjustment chosen from: adjusting an amount of resin supplement being added to the emulsified petroleum source to maintain the resin-to-asphaltene ratio of the initial mixture or the phase-separated mixture above the predetermined critical value; or adding organic acid or organic base to the initial mixture or the phase-separated mixture to maintain the acidic-to basic ratio at from about 0.25 to about 4.0.

17. The method of claim 1, wherein the acidic-to-basic ratio of acidic functional groups to basic functional groups in the supplemented emulsion is adjusted to be from about 0.5 to about 2.0.

18. The method of claim 1, wherein the phase-separated mixture further comprises:

a gas phase above the separated oil phase, the gas phase containing carbon dioxide a mixed phase above the separated aqueous phase and below the separated oil phase, the mixed phase containing the emulsified oil phase and the emulsified aqueous phase of the initial mixture.

19. The method of claim 18, further comprising capturing or recycling the carbon dioxide from the gas phase of the phase-separated mixture.

* * * * *